United States Patent [19]

Tabereaux et al.

[11] Patent Number: 4,673,478

[45] Date of Patent: Jun. 16, 1987

[54] ALUMINA REDUCTION CELL

[75] Inventors: Alton T. Tabereaux, Sheffield, Ala.; Frank L. Gunnip, Massena, N.J.

[73] Assignee: Reynolds Metals Company, Richmond, Va.

[21] Appl. No.: 890,203

[22] Filed: Jul. 28, 1986

[51] Int. Cl.[4] ..... C25C 3/16

[52] U.S. Cl. ..... 204/243 R

[58] Field of Search ..... 204/243 R–247, 204/67

[56] References Cited

U.S. PATENT DOCUMENTS

| | | | |
|---|---|---|---|
| 1,757,695 | 5/1930 | Westly . | |
| 2,739,113 | 3/1956 | Horsfield et al. | 204/243 R |
| 2,769,113 | 10/1956 | Graybeal | 313/327 |
| 2,774,804 | 12/1956 | Dow et al. | 13/18 |
| 3,053,748 | 9/1962 | Morel et al. | 204/243 |
| 3,251,763 | 5/1966 | Carey | 204/286 |
| 3,475,314 | 10/1969 | Johnston | 204/243 |
| 3,493,486 | 2/1970 | Dill | 204/243 |

FOREIGN PATENT DOCUMENTS 898059 11/1953 Fed. Rep. of Germany .

*Primary Examiner*—Donald R. Valentine
*Attorney, Agent, or Firm*—Alan T. McDonald

[57] ABSTRACT

An improved alumina reduction cell is disclosed. The anode channels through which the anode pins are located include openings for the pins which locate the pins to conform more closely to the carbon bake-out zone and line of constant current distribution of the cell.

5 Claims, 4 Drawing Figures

ALUMINA REDUCTION CELL

BACKGROUND OF THE INVENTION

Aluminum is conventionally produced by reduction of alumina dissolved in a molten cryolite bath within an electrolytic reduction cell.

In the Soderberg electrolytic cell, the anode of the cell is maintained by adding a carbonaceous anode paste to the upper surface of the anode. The lower surface of the anode is consumed in the electrolytic process. Thus, at regular intervals, the anode is lowered and the anode paste applied, such that the size of the anode is maintained between acceptable upper and lower limits.

As the anode is lowered, the anode paste is baked into a hardened state, such that when it reaches the position in the anode where it is to be the current conducting portion of the anode, i.e., near the bottom of the anode, it is fully baked.

Electrical current is supplied to the anode through a plurality of anode pins which are located across opposing surfaces of the anode. Once the anode is fully baked, it is extremely difficult, if not impossible, to drive anode pins into it. Thus, it is common practice to insert anode pins into the anode at a substantial distance above the position where these pins are used.

The pins are located across the face of the anode by means of a channel having a plurality of openings therein through which the pins are inserted into a desired position.

With the need for the pins to be inserted into the anode substantially above the vertical position where they are employed, a typical Soderberg anode has, at any given point in time, multiple levels of anode pins and channels vertically "stacked" above one another, with the lowermost set of anode pins at any given time being electrically connected and conducting current through the anode.

As previously mentioned, the anode pins are inserted through openings located in the channels which position the pins both horizontally and vertically. Traditionally, anode channels included a plurality of generally horizontal openings such that the anode pins in a given layer are in a generally horizontal line. Unfortunately, however, this location of the anode pins does not place the majority of the pins in the most ideal location for even current distribution through the anode. During the baking of the anode in operation of the cell, the outer edges of the anode are baked somewhat slower than the center of the anode due to air cooling of the edges of the anode. Thus, the uneven baking causes an uneven current distribution in the cell when electrical current is applied horizontally across the anode. It would be desirable, therefore, to provide for a more even current distribution in the anode by locating the anode pins across the surface of the anode in a way more closely corresponding to the current distribution in the anode.

THE PRESENT INVENTION

By means of the present invention, this desired goal has been obtained. The present invention comprises a modified anode channel for a Soderberg cell which locates the anode pins in a downwardly projecting direction at least near the outer edges of the anode. The channel itself may be arced or may be generally horizontal. However, the anode pin locating openings within the channel in either case provide the desired anode pin pattern.

BRIEF DESCRIPTION OF THE DRAWINGS

The present invention will be more fully described with reference to the FIGURES in which.

DETAILED DESCRIPTION OF THE PREFERRED EMBODIMENTS

Figure 1:
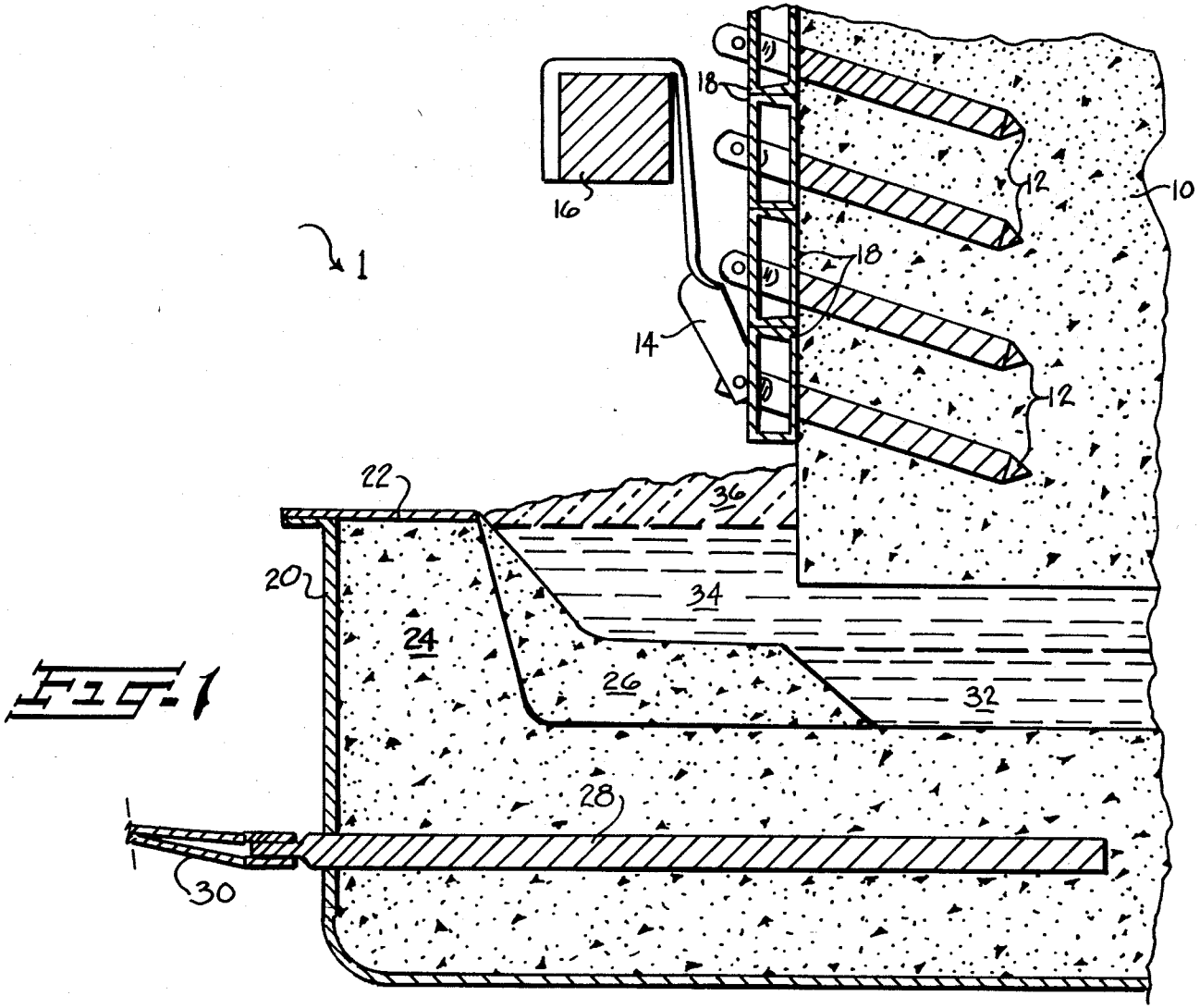
FIG. 1 is a partial cross-sectional view of a Soderberg electrolytic cell including the improved anode channel of the present invention.

Turning to the FIGURES, in FIG. 1 a partial cross-sectional view of a Soderberg alumina reduction cell 1 is illustrated. As shown, approximately one-half of the cell is illustrated. The other side of the cell is a mirror image of that shown. The cell 1 comprises an anode 10 formed from carbonaceous anode paste and a cathode 24 formed of carbonaceous material.

The cathode 24 is enclosed within a steel shell 20 having a partial cover 22 and includes a ledge 26 also formed of carbonaceous material. Embedded within cathode 24 are current carrying rods or pins 28 which by means of connectors 30 are connected to a current carrying bus (not shown). Molten aluminum 32 rests upon carbonaceous cathode 26 and is beneath a molten cryolite-alumina bath 34 having a crust 36 on top thereof.

The anode 10 includes a plurality of layers of anode pins 12 positioned therein. Each of the layers of anode pins 12 pass through an anode channel 18.

The bottommost layer of anode pins 12 are connected by means of flexible connectors 14 to an electrical bus 16. As the anode 10 is consumed, the lowermost anode pins 12 are removed, as is the lowermost anode channel 18 and the flexible connector 14 is then connected to the next higher layer of anode pins 12, with a new anode channel 18 and anode pins 12 being positioned above the uppermost layer of anode pins 12.

Figure 2:
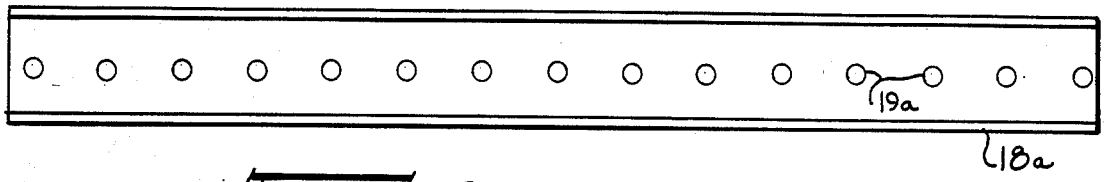
FIG. 2 PRIOR ART
FIG. 2 is a side elevational view of an anode channel according to the prior art.

FIG. 2 illustrates a typical anode channel of the prior art 18*a*. This channel 18*a* includes a plurality of openings 19*a* through which the anode pins 12 pass for location into anode 10. As can be seen, these openings 19*a* form a generally horizontal line across the face of the anode 10.

As previously mentioned, the anode 10 bakes outwardly from its center to its outer edges. Thus, the outer edges of the anode 10 are less fully baked than the center of the anode 10 at a given horizontal cross-section of the anode 10. A constant current distribution line within the anode 10 follows the line of even baking.

Figure 3:
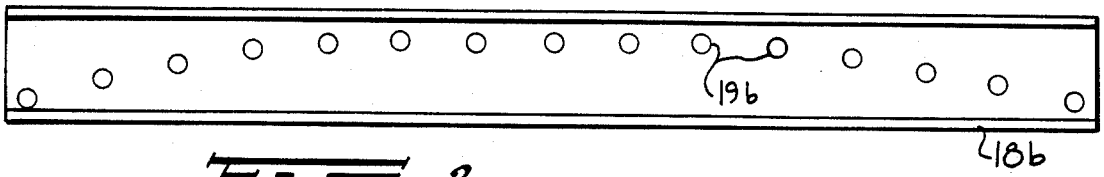
FIG. 3 is a side elevational view of a first embodiment of an improved anode channel according to the present invention.

FIGS. 2 and 3 illustrate modified anode channel 18*b* and 18*c* according to the present invention. In FIG. 3, the channel 18*b* is generally horizontal, similar to channel 18*a* in FIG. 2. However, the openings 19*b* in channel 18*b* are not horizontal, but are generally downwardly sloping from the center of channel 18*b* to the outer edges of channel 18*b*. In this FIGURE, several of the centermost openings 19*b* are in a generally horizontal configuration. In a relatively large anode, while the outermost areas of anode 10 bake less rapidly than the central portion of anode 10, the majority of the center of the anode 10 bakes at a fairly constant rate, such that there is a region in the center of the anode 10 where a generally horizontal anode pin configuration follows the line of constant current distribution within anode 10.

Figure 4:
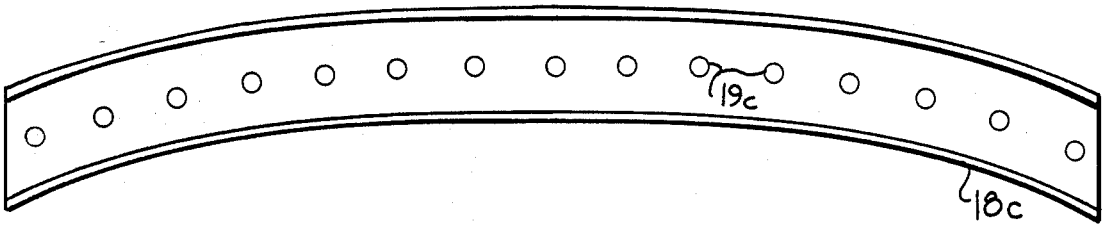
FIG. 4 is a side elevational view of a second embodiment of an improved anode channel according to the present invention.

In FIG. 4, the anode channel 18*c* is itself arced downwardly. As shown, the openings 19*c* are similar to the openings 18*b* in FIG. 3, with the centermost openings 19*c* generally horizontal and the openings 19*c* adjacent the edges of channel 18*c* sloping downwardly. The channel 18*c* is itself shaped to conform to the line of constant current distribution, such that the openings 19*c* fall midway from the top to the bottom of channel 18*c*. Alternatively the channel 18*c* the bottom of channel 18*c*. Alternatively, the channel 18c could be a constant arc, in which case the openings 19*c*, depending on the size of the anode, may or may not fall midway from top to bottom of such a channel.

When employing the improved anode channels of the present invention, the current efficiency of the cell is improved substantially. This permits lower operating voltages, increased operation stability, increased productivity and reduced electrical costs.

While the channels have been illustrated as having a arc-like downward slope at the outer edges thereof for the anode pin openings, it is clear that this downward slope could be other than arc-like, such as a straight line or other arrangement which closely conforms to the line of constant current distribution for the cell. The exact arrangement of the anode pin openings in the channel could be experimentally chosen for a given type and size of cell.

From the foregoing, it is clear that the present invention provides a simple improvement to the electrolytic cell reduction operation.

While the invention has been described with reference to certain specific embodiments thereof, it is not intended to be so limited thereby, except as set forth in the accompanying claims.

We claim:

1. In an alumina reduction cell having a cathode and an anode, said anode being formed of a carbonaceous paste and baked during operation of said cell and said anode having rows of anode pins on opposing faces thereof, said pins being positioned by passing said pins through openings in anode channels vertically stacked along said opposing faces of said anode, the lowermost row of said anode pins carrying current through said anode, the improvement wherein said anode channels are each constructed and arranged to position said anode pins passing therethrough along a line of constant current distribution in said anode.

2. The cell of claim 1 wherein said channels are generally horizontal and wherein said openings in said channels follow said line of constant current distribution.

3. The cell of claim 1 wherein said channels are shaped to follow said line of constant current distribution and said openings are positioned on the centerline of said channels.

4. The cell of claim 1 wherein said line of constant current distribution is generally horizontal along the central position of the faces of said anode and slopes downwardly adjacent the outer edges of said anode.

5. The cell of claim 1 wherein said line of constant current distribution is a generally downwardly directed arc having its highest point at the center of the faces of said anode.

* * * * *